United States Patent [19]

Milo

[11] Patent Number: 4,863,152

[45] Date of Patent: Sep. 5, 1989

[54] HIGH SPEED QUARTER-FOLDER

[75] Inventor: Alfred Milo, Coconut Creek, Ga.

[73] Assignee: QFC, Inc., Oquaka, Ill.

[21] Appl. No.: 188,452

[22] Filed: Apr. 29, 1988

[51] Int. Cl.[4] ..... B42C 1/04

[52] U.S. Cl. ..... 270/47; 493/422; 493/443; 493/444; 493/445

[58] Field of Search ..... 270/20.1, 32, 45, 47; 493/422, 443, 444, 445

[56] References Cited

U.S. PATENT DOCUMENTS 4,338,088 7/1982 Buss ..... 493/445

FOREIGN PATENT DOCUMENTS 0210633 2/1987 European Pat. Off. ..... 270/45
1958764 5/1971 Fed. Rep. of Germany ..... 493/444
2455513 1/1981 France ..... 493/444
1014771 4/1983 U.S.S.R. ..... 270/32

*Primary Examiner*—Robert E. Garrett
*Assistant Examiner*—Therese M. Newholm
*Attorney, Agent, or Firm*—James B. Middleton

[57] ABSTRACT

A quarter-folder operates at high speed by reducing the leading edge to leading edge distance between successive papers, and continuing to move the papers forward while urging the papers down between folding rolls. The folding rolls are obliquely disposed so that a tucking blade urges a portion of the paper between the rolls, and the angular disposition causes the paper to continue. A plurality of pairs of folding rolls receives a paper for complete folding. Retarding brush rollers will slow the folded paper to be received by a conventional creel.

15 Claims, 4 Drawing Sheets

HIGH SPEED QUARTER-FOLDER

INFORMATION DISCLOSURE STATEMENT

With the present day high speed printing presses, it is common to print newspaper-sized materials, whether newspapers or advertisements or the like, and to fold the sheets in half for delivery, this folding being known as a half-fold. For many items, especially the thinner items such as advertisements, small daily papers and the like, it is common to fold the half-folded paper again so that the paper is quarter-folded. Though many pieces are quarter-folded each day, there has never been a quarter-folder that operated at a sufficiently high speed to receive the materials directly from the press, and to maintain production in series with the press. This necessitates the gathering of half-folded papers, transporting the half-folded papers to a separate apparatus, and subsequently quarter-folding the collected papers. Such a procedure is inefficient in use of both men and machines, and a quarter-folder that will operate in line with a press is badly needed.

SUMMARY OF THE INVENTION

This invention relates generally to quarter-folders for newspapers and the like, and is more particularly concerned with a high speed quarter-folder for receiving papers directly from a high speed press.

The present invention provides a plurality of pairs of rolls, the axes of rotation of all of the pairs of rolls being oblique with respect to the path of the incoming paper so that the angle between the paper and the axes of the rolls will form an acute angle. Means is provided for tucking the center of the incoming paper into the nip between the rolls; and, rotation of the rolls will cause continuous forward and downward movement of the paper to complete a fold in the paper.

Depending on the speed of the printing press, it may be necessary to slow the paper before the paper enters the folding rolls. For this purpose, the paper is received from the printing press on a first vacuum belt, the first vacuum belt being operated by speed change means so timed that, when a paper is received on the first vacuum belt, the first vacuum belt and the newspaper are travelling at the same speed. At the end of travel on the first vacuum belt, the newspaper will be travelling at the same speed as a second vacuum belt that feeds the papers to the folding rolls.

Since the quarter-folded papers will be travelling at high speed as they emerge from the folding rolls, means may be provided for slowing the speed of the newspapers before the papers are received by a creel for ultimate delivery to a conveyor belt.

BRIEF DESCRIPTION OF THE DRAWINGS

These and other features and advantages of the present invention will become apparent from consideration of the following specification when taken in conjunction with the accompanying drawings in which.

DETAILED DESCRIPTION OF THE EMBODIMENT

Figure 1:
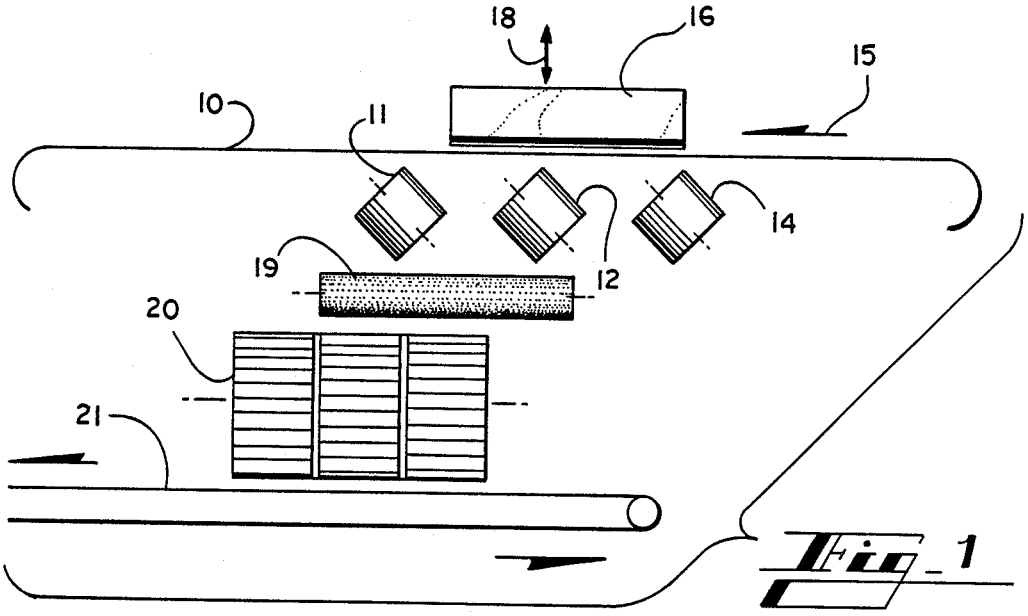
FIG. 1 is a somewhat schematic, side-elevational view showing one form of apparatus made in accordance with the present invention.

Referring now more particularly to the drawings, and to that embodiment of the invention here presented by way of illustration, it will be seen in FIG. 1 of the drawings that there is a conveyor, or vacuum belt, 10 and a plurality of pairs of rolls designated at 11, 12 and 14. Each of the rolls 11, 12 and 14 has a centerline, and it will be seen that the centerlines are equiangular with respect to the belt 10, and all form an acute angle with an incoming paper, the paper moving in the direction of the arrow 15.

Generally above the folding rolls 11, 12 and 14, there is a tucking means indicated at 16. The tucking means 16 is here shown generally as an elongate blade or the like, the blade being vertically reciprocable as indicated by the arrow 18. Thus, when a paper is on the belt 10, the tucking means 16 can be lowered to cause the center of the incoming paper to be tucked into the nip between the pairs of rolls 11, 12 and 14. With the pairs of rolls rotating, it will be understood that, once the paper is in the nip of the rolls, the paper will be pulled further into the rolls. This will be discussed in more detail hereinafter.

As a paper emerges from the folding rolls 11, 12 and 14, it will be understood that the paper will move forwardly and downwardly from the folding rolls. Thus, the paper will be discharged in the vicinity of the pairs of rollers 19. The rollers 19 are here indicated as brush rollers, and it is contemplated that the brush rollers 19 will be rotating to urge the paper downwardly; however, the brush rollers 19 may be operating at a surface speed lower than the rate of travel of the paper from the folding rolls. The result will of course be that the paper is fed to the creel 20, but the travel of the paper will be slowed by the brush rollers 19. Thus, the brush rollers 19 constitute a retarding means for the quarter-folded paper.

As the paper emerges from the retarding means 19, it will be received by a generally conventional creel 20. The creel 20 will deposit the paper on the delivery conveyor 21 as is well known in the art.

Figure 2:
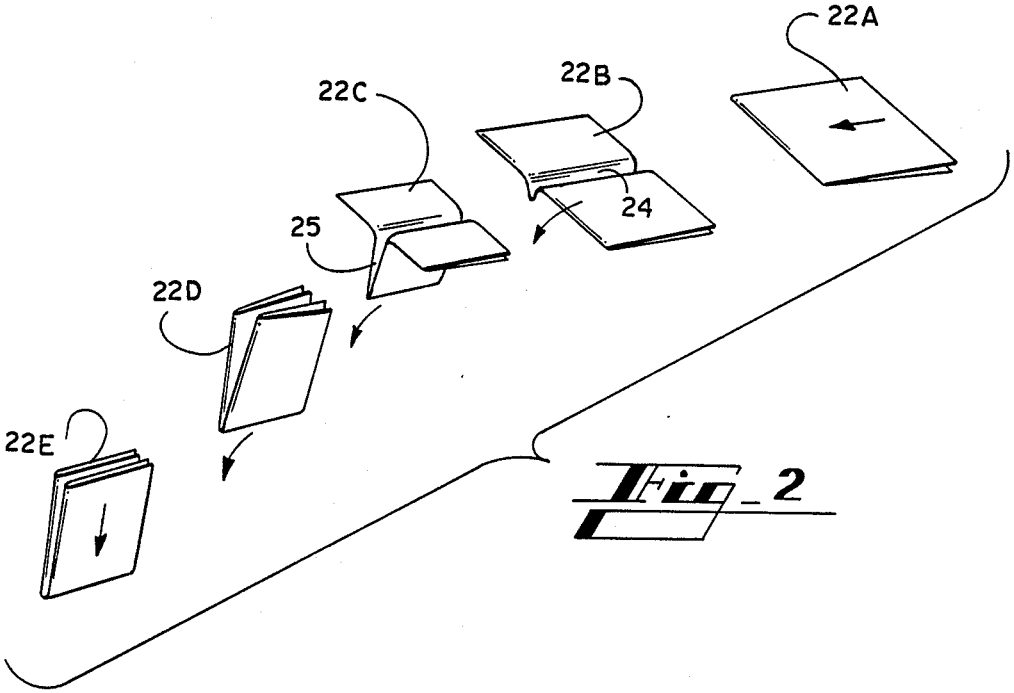
FIG. 2 is a perspective illustration showing the steps involved in quarter-folding a half-folded paper.

With the foregoing general description of the apparatus in mind, attention is directed to FIG. 2 of the drawings. In FIG. 2 it will be seen that there is a half-folded paper indicated at 22A, the paper 22A moving in the direction of the arrow on the paper. It will therefore be understood that the paper 22A is shown as it would be entering the conveyor 10, before the folding rolls 11, 12 and 14. The next paper in FIG. 2 is indicated at 22B, and the center of the paper 22B has V-fold 24. This V-fold 24 indicates the condition wherein the tucking means 16 has tucked the central portion of the paper into the nip of the folding rolls. The paper 22B therefore moves in the direction of the arrow, the motion being generally perpendicular to the axes of the folding rolls.

The next paper in FIG. 2 is designated at 22C, and it will be seen that the V-fold 24 of paper 22B has become elongated, and is now indicated at 25. As the central portion of the paper 22 moves downwardly between the folding rolls, the outer ends of the paper 22 are at first held by the vacuum belts 10, but the paper simply slides off the vacuum belts 10 as the central portion of the paper is pulled downwardly between the folding rolls 11, 12 and 14.

The next paper in FIG. 2 is designated at 22D, and this paper is completely folded. The paper 22D is still moving in the same direction since it has not yet emerged from the last pair of folding rolls, such as the rolls 11.

Finally, the last paper in FIG. 2 is designated at 22E, and this paper is completely quarter-folded, and is indicated as moving vertically. The paper 22E represents the paper after it has emerged from the last of the folding rolls, and is engaged by the retarding means 19. Thus, the paper 22E will be slowed somewhat in its travel, and will be deposited in a creel such as the creel 20, or other collection means.

From the foregoing description it will be understood by those skilled in the art that the method and apparatus of the present invention provide generally conventional vacuum belts for holding a paper to be quarter-folded, and for feeding the paper uniformly towards the quarter-folder. The center of the half-folded paper is tucked downwardly into the nip of opposed, angularly disposed folding rolls, and the folding rolls move the paper both forwardly and downwardly to accomplish the quarter-folding without stopping the forward motion of the paper. This fact increases the efficiency of the folding operation and lowers the probability of damaged papers due to a rapid stop. After the paper has been quarter-folded, the paper can be slowed somewhat in speed and deposited into a creel or other collection means.

Figure 3:
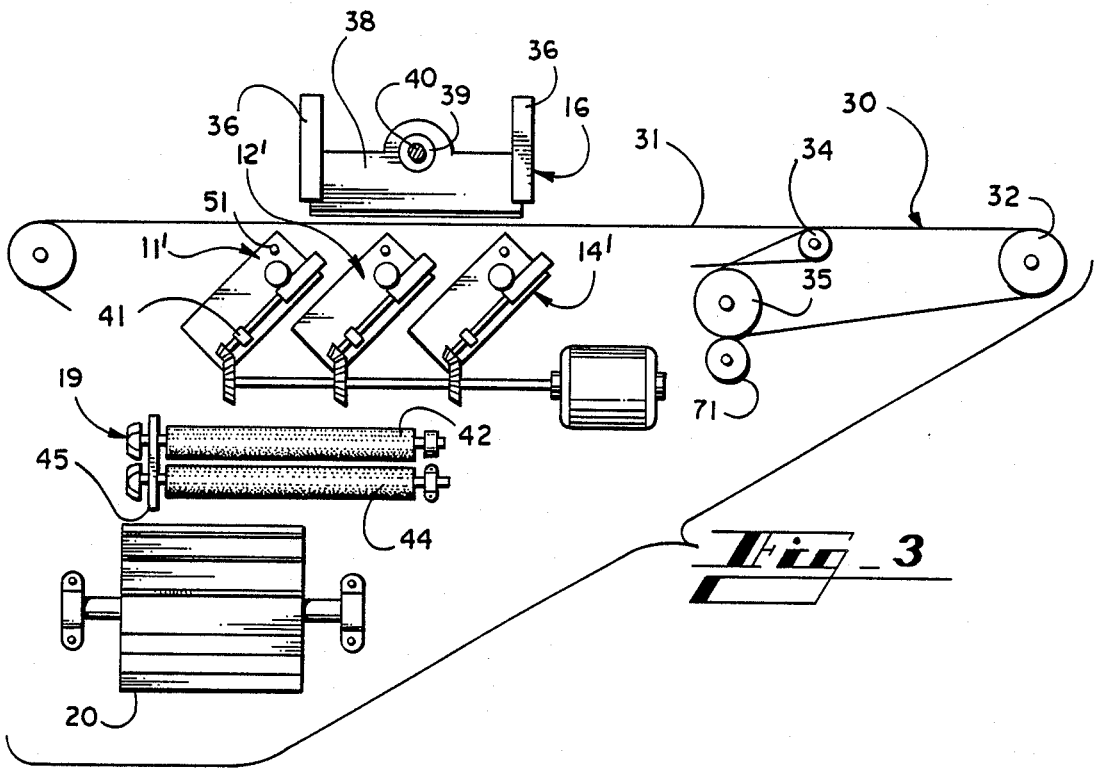
FIG. 3 is a view similar to FIG. 1, showing more mechanical details than the schematic FIG. 1.

With the above in mind, attention is directed to FIG. 3 of the drawings which shows a first vacuum belt, or in-feed belt, 30 and a second vacuum belt 31, the vacuum belt 31 being the belt that carries a half-folded paper into the quarter-folder. The roller 32 of the in-feed conveyor 30 will receive half-folded papers directly from the printing press, so the papers at this point will be moving at a very high speed. In the distance from the roller 32 of the in-feed conveyor 30 to the roller 34 of the conveyor 31, the speed of the paper will be slowed considerably until the paper is travelling at the same speed as the second conveyor 31. The means for changing the speed of the conveyor 31 is indicated at 35, and the speed changing transmission 35 will be described in more detail hereinafter.

At this point it should be understood that the speed of the in-feed conveyor is constantly changed, the conveyor having a high speed as a paper is received from the printing press. While the in-feed conveyor 30 is carrying the paper, the speed of the conveyor 30 is reduced until the speed of the conveyor 30 is equal to the speed of the conveyor 31 for the paper to be transfered from the conveyor 30 to the conveyor 31.

Above the conveyor 31 is the tucking means, again generally indicated at 16. The tucking means 16 is here shown as including a pair of guides 36 slidably receiving a blade 38. The blade 38 is provided with an eccentric drive 39 having a drive shaft 40. Thus, as the drive shaft 40 is rotated, the eccentric drive 39 will cause vertical reciprocation of the tucking blade 38, the blade 38 riding in the guides 36.

Below the tucking means 16, there are three folding roll assemblies designated generally at 11', 12' and 14'. While the folding roll assemblies 11', 12' and 14' perform the same function as the rolls 11, 12 and 14 in FIG. 1, the arrangement shown in FIG. 3 is in more detail, and includes angle changing means generally indicated at 41. This will be described further hereinafter.

Below the folding roll assemblies 11', 12' and 14' is the retarding means generally designated at 19, the retarding means being here shown as including two pairs of brush rollers, the upper pair being designated at 42 and the lower pair at 44. The two brush rollers 42 and 44 are drivingly connected by means of a belt 45 so that the two rollers will rotate in the same direction. While it is contemplated that the two rollers will be driven at substantially the same speed, it will be readily understood that the lower roller 44 can be driven at a slower speed than the upper roller 42 so that the paper can be received at the higher speed of the roller 42 and subsequently slowed by the roller 44. Many variations in operation will occur to those skilled in the art.

Figure 4:
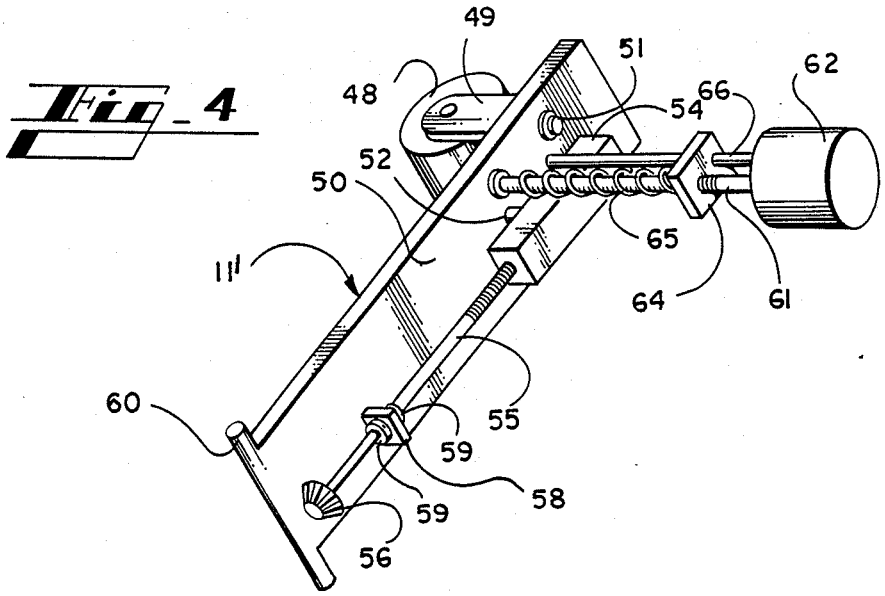
FIG. 4 is a perspective view of the mounting arrangement for one of the folding rolls shown in FIG. 3.

The folding roll assemblies 11', 12' and 14' are all alike, and one of these is illustrated in more detail in FIG. 4 of the drawings. For purposes of illustration, the folding roll assembly in FIG. 4 is designated at 11'.

The folding roll assembly 11' includes the folding roll 48 mounted on a clevis 49. The clevis 49 is pivotally fixed to a mounting board 50 by a stud 51. The opposite side of the clevis 49 is adjustably held to the mounting board 50 by a stud or the like passing through an arcuate slot 52; and, the stud is fixed to an internally threaded block 54. The result is that, as the block 54 moves up and down, the end of the clevis 49 will be moved up and down, so the stud will move through the arcuate slot 52. This will cause rotation of the roll 48 about the stud 51 to change the angle of the centerline of the roll 48.

To cause the appropriate motion of the block 54, there is a threaded shaft 55 having a gear 56 for rotating the shaft 55. A flange 58 is fixed to the mounting board 50, and collars 59 fixed on each side of the flange 58 prevent axial motion of the shaft 55. As a result, when the shaft 55 is rotated, the block 54 will move up or down the shaft, depending on the direction of rotation of the shaft 55. Thus, by rotation of the gear 56, the angle of the folding roll 48 can be varied.

It is also desirable to have some means for varying the space between opposed rolls in each pair of folding rolls, or to vary the tension place on a paper passing through the rolls. For this purpose, the mounting plate 50 is provided with a mounting axle 60 so the roll 48 can pivot about the axle 60. To allow the pivotal motion about the axle 60, while retaining control, there is a shaft 61 operated by a motor 62. The shaft 61 is threaded, and receives a threaded pressure plate 64 thereon. A spring 65 between the pressure plate 64 and the mounting plate 50 will be compressed more or less, depending on the location of the pressure plate 64. A stablizing shaft 66 is fixed to the motor 62, and slidably passes through the pressure plate 64 to prevent rotation of the pressure plate 64. It will therefore be understood that, as the motor 62 causes rotation of the shaft 61, the pressure plate 64 will move towards or away from the mounting plate 50, causing more or less tension on the spring 65.

Figure 5:
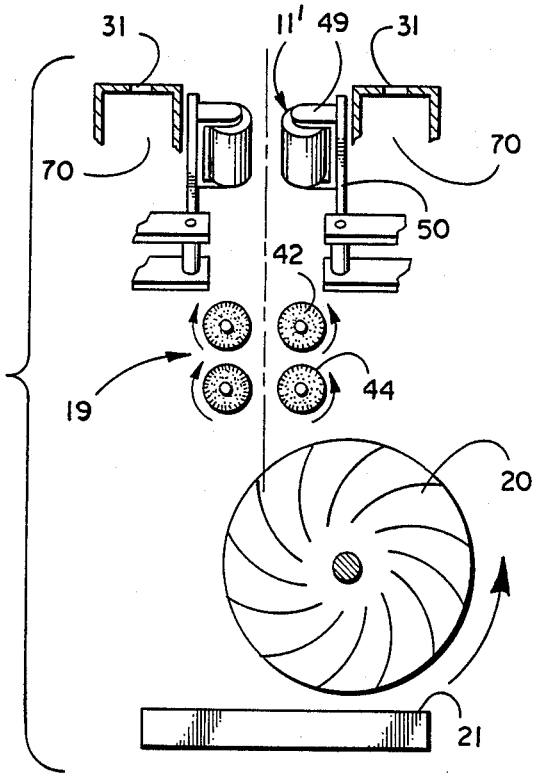
FIG. 5 is an elevational view taken substantially along the line 5—5 in FIG. 3; and, FIG. 6 is an exploded perspective view showing one form of speed changing arrangement for the vacuum belt.

Looking briefly at FIG. 5 of the drawings, it will be seen that the various pieces of apparatus have already been discussed, and their relationship to one another has been reasonably well described. In FIG. 5, it is shown that there is a pair of each of the items, including the vacuum belts 31, and the folding roll assemblies 11', as well as the retarding means including the brush rollers 42 and 44. In FIG. 5, it is indicated that there is a vacuum chamber 70 below each of the belts 31. The use of the vacuum belts is extremely well known in the industry, and it will be well understood by those skilled in the art that, typically, a vacuum chamber such as the chamber 70 is provided, and a belt 31 having a plurality of holes therein closes the top of the vacuum chamber 70. As a result, the paper or the like placed over the holes in the belt 31 will be adhered to the belt because of the pressure differential.

One of the steps to be considered in operation of the present invention is the shortening of the space between successive papers. The papers typically exit from the printing press with a relatively large spacing from leading edge to leading edge. Obviously, any equipment must consider this distance in terms of time in a subsequent operation on the papers. In view of this large spacing, the present invention includes the in-feed conveyor 30 to slow the incoming papers, thereby to lessen the distance from leading edge to leading edge. Nevertheless, the distance between the papers is maintained as sufficient for individual quarter folding and ultimate placement into the creel 20.

Figure 6:
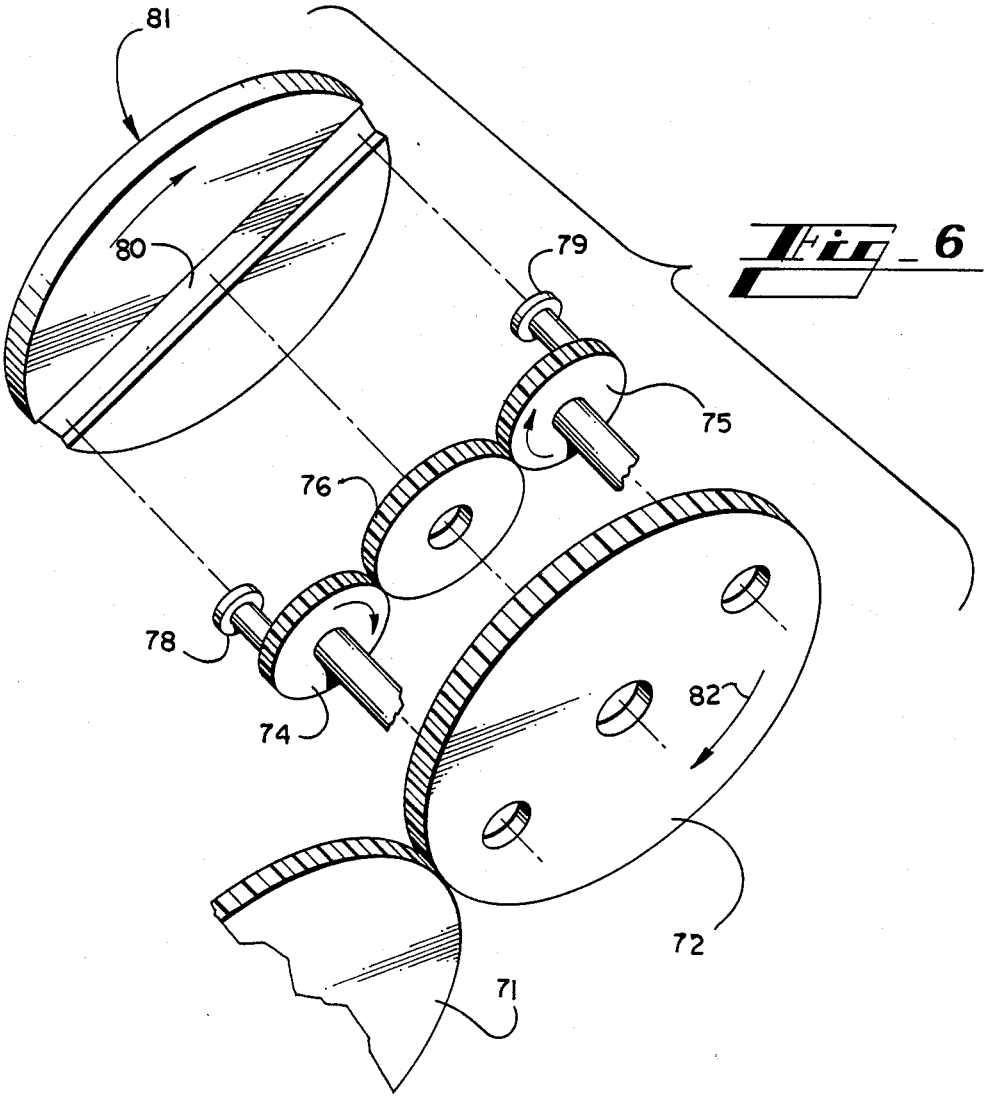

While many forms of drive mechanisms may be utilized to achieve the speed changes in the in-feed conveyor 30, one mechanism is illustrated in FIG. 6 of the drawings.

Looking at FIG. 6, the input drive means is indicated as a gear 71, the gear 71 also being indicated in FIG. 3 for proper orientation. Gear 71 drives a large gear 72, the gear 72 having mounted thereon two planetary gears 74 and 75. Since the shafts of the gears 74 and 75 are carried by the gear 72, when the gear 72 is rotated, the shafts of the gears 74 and 75 will be moved about in a circular path.

Each of the planetary gears 74 and 75 is meshed with a sun gear 76, the sun gear 76 being held stationary. As a result, as the planetary gears 74 and 75 are caused to rotate about the sun gear 76, the planetary gears 74 and 75 will rotate due to their meshing with the sun gear 76.

Each of the planetary gears 74 and 75 carries an eccentricly mounted, forwardly extending drive roller 78 and 79. The drive rollers 78 and 79 are received within a diametrical slot 80 in the plate 81. Since the rollers 78 and 79 are within the slot 80, as the planetary gears 74 and 75 are carried around in a circle, the plate 81 will also be rotated in accordance therewith.

Looking further at the particular motions involved, it will be seen that, when the gear 72 is rotating clockwise as indicated by the arrow 82, the planetary gears 74 and 75 will have a gross motion in a clockwise direction also. Since the sun gear 76 is stationary, and is meshed with the gears 74 and 75, the gears 74 and 75 will each have a separate clockwise rotation about their axes, in addition to their gross clockwise motion about the sun gear 76.

Looking, then, at the combination of motions, it will be seen that the gear 74 will be moving in a clockwise direction to carry the plate 81 in a clockwise direction. While the roller 78 is located in the outer half of the gear 74, it will be seen that the rotation of the gear 74 about its axis will causes a motion added to the rotation of the gear 82. The result will be that the plate 81 will be rotated at a higher speed than the rotation of the gear 72. Contrarily, when the roller 78 is on the inside of the gear 74, towards the sun gear 76, the rotation of the gear 74 will cause a subtraction from the rotation of the gear 72, so the plate 81 will rotate at a slower speed than the gear 72.

While the gear 74 has been discussed, it will be understood that the gear 75 will act in precisely the same manner, and in fact only one of the gears 74 and 75 might be used and the operation would be the same. The use of the two planetary gears 74 and 75 will produce a better balance in forces, and is more desirable mechanically.

Remembering the changing speed of the in-feed conveyor 30, it will be recognized that the drive means provides a relatively simple arrangement to allow the high speed of the conveyor 30, followed by the rapid slowing of the conveyor 30 until the speed of the conveyor 30 is equal to the speed of the conveyor 31. The speed of the conveyor 30 is then increased so the next paper can be received with the conveyor 30 operating at the speed of the printing press, and the cycle is repeated.

It will therefore be seen that the present invention provides a method and apparatus for receiving half folded papers or the like, and quarter folding those papers at a sufficiently high speed to meet the output of conventional high speed printing presses. The method includes the steps of tucking the half folded paper into nips of inclined rollers, and allowing the inclined rolls to fold the half folded paper while moving the paper downwardly and forwardly. The quarter folded paper is then slowed in its motion, and placed into a collection means.

It will of course be understood by those skilled in the art that the particular embodiment of the invention here presented is by way of illustration only, and is meant to be in no way restrictive; therefore, numerous changes and modifications may be made, and the full use of equivalents resorted to, without departing from the spirit or scope of the invention as outlined in the appended claims.

I claim:

1. A quarter-folder for folding papers and the like, said quarter-folder including conveyor means for holding a paper to be folded and for moving said paper along a path, a plurality of pairs of folding rolls, each pair of said folding rolls defining a nip located along said path, the axes of all rolls of said plurality of pairs of folding rolls being obliquely oriented with respect to said path such that said axes form an acute angle with an incoming paper held by said conveyor means, means for urging a portion of said paper into said nip of the first pair of said plurality of pairs of folding rolls and means for driving said rolls for urging said paper between said rolls, each pair of rolls subsequent to said first pair of folding rolls of said plurality of pairs of folding rolls being so located as to receive said paper from the preceding pair of folding rolls.

2. A quarter-folder as claimed in claim 1, said means for urging a portion of said paper into said nip including a tucking blade, and means for moving said tucking blade towards said paper while said paper is held by said conveyor.

3. A quarter-folder as claimed in claim 2, and further including an in-feed conveyor for delivering papers to be folded to said conveyor means, and speed changing means for for varying the speed of said in-feed conveyor.

4. A quarter-folder as claimed in claim 3, and including retarding means for slowing said paper after said paper exits from said folding rollers.

5. A quarter-folder as claimed in claim 4, said retarding means comprising a pair of rollers positioned to receive said paper therebetween, said pair of rollers rotating with a surface speed less than the speed of said paper.

6. A quarter-folder as claimed in claim 5, said pair of rollers comprising brush rollers.

7. A quarter-folder as claimed in claim 1, and further including a plurality of mounting assemblies, each folding roll of said plurality of pairs of folding rolls being mounted in one of said mounting assemblies, each of said mouting assemblies including a mounting board pivotally carried at one end thereof, a clevis carrying said folding roll, said clevis being pivotally carried by said mounting board, and means for adjusting the angular position of said clevis with respect to said mounting board.

8. A quarter folder as claimed in claim 7, and further including means for moving said mounting board pivotally about said one end.

9. A quarter-folder as claimed in claim 7, said means for adjusting the angular position of said clevis including a gear, a shaft extending adjacent to said plurality of mounting assemblies, a plurality of adjusting gears fixed to said shaft for engaging said gear of said means for adjusting the angular position of said clevis and means for selectively rotating said shaft.

10. A method for quarter-folding papers and the like, said method comprising the steps of feeding a paper to be folded in a first direction along a path, engaging said paper with a tucking blade to form a V-fold in said paper, and grasping said V-fold with the nip of a first pair of folding rolls obliquely disposed with respect to said path with the axes of said folding rolls forming an acute angle with the path of a paper passing between said folding rolls, so that said paper is moved downwardly while continuing in said first direction in passing between said pair of folding rolls.

11. A method as claimed in claim 10, and further including the step of receiving said paper from said pair of folding rolls with a second pair of folding rolls having axes parallel to the axes of said first pair of folding rolls, and continuing such step until said paper is completely folded.

12. A method as claim in claim 11, and including the step of slowing the speed of said paper as said paper emerges from said folding rolls, and subsequently receiving said paper in a collection means.

13. A method as claimed in claim 12, wherein said step of feeding a paper along a path is carried out by carrying said paper on a pair of vacuum belts.

14. A method as claimed in claim 13, and further including the steps of receiving said paper with an in-feed conveyor traveling at the same speed as said papers, slowing the speed of said in-feed conveyor as said paper moves towards said pair of vacuum belts, and transferring said paper from said in-feed conveyor to said vacuum belts with said paper moving at the same speed as said vacuum belts.

15. A method as claimed in claim 14, and wherein a plurality of papers is fed along said path, said plurality of papers having their leading edges spaced apart a first distance, and further including the steps of placing said plurality of papers successively on said in-feed conveyor and slowing the speed of said in-feed conveyor to reduce the distance between successive papers, and subsequently increasing the speed of said in-feed conveyor to repeat the said step of receiving said paper with an in-feed conveyor traveling at the same speed as said papers.

* * * * *